US007836519B2

(12) United States Patent
Zahler

(10) Patent No.: US 7,836,519 B2
(45) Date of Patent: Nov. 23, 2010

(54) CHEF SUIT GARMENT

(76) Inventor: Todd T. Zahler, 129 Beacon Run West, Columbus, OH (US) 43228-1556

( * ) Notice: Subject to any disclaimer, the term of this patent is extended or adjusted under 35 U.S.C. 154(b) by 809 days.

(21) Appl. No.: 11/112,395

(22) Filed: Apr. 22, 2005

(65) Prior Publication Data

US 2006/0236440 A1 Oct. 26, 2006

(51) Int. Cl.
*A41D 1/00* (2006.01)
*A41D 13/00* (2006.01)

(52) U.S. Cl. ..... 2/69; 2/95; 2/96; 2/97

(58) Field of Classification Search ..... 2/180, 2/102, 69, 71, 72, 75, 80, 86, 95, 97, 96, 2/81, 70

See application file for complete search history.

(56) References Cited

U.S. PATENT DOCUMENTS

| | | | | | |
|---|---|---|---|---|---|
| 289,236 | A | * | 11/1883 | Dodge et al. | 2/51 |
| 681,821 | A | * | 9/1901 | Tomlin | 2/103 |
| 920,688 | A | * | 5/1909 | Taylor | 2/71 |
| 1,072,776 | A | * | 9/1913 | Routery | 2/70 |
| 1,076,586 | A | * | 10/1913 | Langman | 2/71 |
| 1,093,354 | A | * | 4/1914 | Pelton et al. | 2/67 |
| 1,254,043 | A | * | 1/1918 | James | 450/31 |
| 1,298,043 | A | * | 3/1919 | Hollander | 2/70 |
| 1,405,694 | A | * | 2/1922 | Talianoff | 2/72 |
| 1,476,831 | A | * | 12/1923 | Pease | 2/70 |
| 1,479,854 | A | * | 1/1924 | Heller | 2/79 |
| 1,602,235 | A | * | 10/1926 | Maril | 2/79 |
| 1,626,450 | A | * | 4/1927 | Cannon | 2/64 |
| D82,570 | S | * | 11/1930 | Longnecker | D2/739 |
| 1,810,237 | A | * | 6/1931 | Cahn | 2/212 |
| 1,915,597 | A | * | 6/1933 | Ducker | 2/95 |
| 2,104,487 | A | * | 1/1938 | Kessler | 2/70 |
| 2,130,690 | A | * | 9/1938 | Hyatt | 2/70 |
| 2,152,575 | A | * | 3/1939 | Urbon | 2/70 |
| 2,189,187 | A | * | 2/1940 | Turunen | 2/96 |
| 2,208,906 | A | * | 7/1940 | Leone | 2/71 |
| 2,211,100 | A | * | 8/1940 | Cohen | 2/70 |
| 2,211,966 | A | * | 8/1940 | Attman | 2/71 |
| 2,225,126 | A | * | 12/1940 | Nasher | 2/85 |
| 2,242,365 | A | * | 5/1941 | Muhr | 2/70 |
| 2,260,426 | A | * | 10/1941 | Bailey | 2/96 |
| 2,292,348 | A | * | 8/1942 | Bailey | 2/97 |
| 2,301,527 | A | * | 11/1942 | English et al. | 2/95 |
| 2,303,536 | A | * | 12/1942 | Friedman | 2/74 |

(Continued)

*Primary Examiner*—Alissa L Hoey
(74) *Attorney, Agent, or Firm*—The Webb Law Firm

(57) ABSTRACT

A uniform-type chef suit garment that appears to have physically separate jacket and pants but that includes an upper torso jacket and liner which is attached to the pants to optimize comfort by eliminating a fitted waist, while improving serviceability during cleaning of the garment. The garment includes various means that enable the wearer to don and remove the chef suit. In various embodiments, the pants are further adapted to be adjustable in length or to have a length limiting feature to prevent undesirable wear and soiling of the cuffs. In various preferred configurations, the jacket may preferably also incorporate a jacket taper adjustment feature as well as various implement holding elements that can be adapted to retain towels, gloves, cooking utensils, and other implements. In various alternative modifications, reversible breast lapels are incorporated into the garment to prolong clean and professional appearance and serviceability in operational food service environments.

14 Claims, 8 Drawing Sheets

U.S. PATENT DOCUMENTS

| | | | | | |
|---|---|---|---|---|---|
| 2,308,929 | A | * | 1/1943 | Mintzes | 2/71 |
| 2,322,510 | A | * | 6/1943 | Friedman | 2/97 |
| 2,385,871 | A | * | 10/1945 | Liebert | 2/71 |
| 2,391,352 | A | * | 12/1945 | Schwartz | 2/93 |
| 2,443,447 | A | * | 6/1948 | Falcon | 2/93 |
| 2,465,286 | A | * | 3/1949 | Silversteen | 2/51 |
| 2,523,416 | A | * | 9/1950 | Brennan | 2/80 |
| 2,562,234 | A | * | 7/1951 | Gottschalk | 2/117 |
| 2,875,445 | A | * | 3/1959 | Armigene | 2/71 |
| 3,404,408 | A | * | 10/1968 | Berman | 2/96 |
| 3,737,916 | A | * | 6/1973 | Grenier | 2/70 |
| 4,663,781 | A | * | 5/1987 | Krosby | 2/86 |
| 4,797,954 | A | * | 1/1989 | Williams et al. | 2/106 |
| 5,038,410 | A | * | 8/1991 | Grilliot et al. | 2/81 |
| 5,040,243 | A | * | 8/1991 | Tatsuno | 2/108 |
| 5,095,549 | A | * | 3/1992 | Aldridge | 2/304 |
| 5,182,812 | A | * | 2/1993 | Goldsby | 2/79 |
| 5,189,737 | A | * | 3/1993 | Ribicic | 2/93 |
| 5,218,720 | A | * | 6/1993 | Tolton | 2/97 |
| 5,267,352 | A | * | 12/1993 | Rodarmel | 2/44 |
| 5,274,851 | A | * | 1/1994 | Simpkins et al. | 2/102 |
| 5,343,565 | A | | 9/1994 | Berni | |
| D355,295 | S | | 2/1995 | Berni | |
| 5,488,738 | A | * | 2/1996 | Seamans | 2/69 |
| 5,611,086 | A | * | 3/1997 | Eggen | 2/104 |
| 5,946,726 | A | * | 9/1999 | Green | 2/109 |
| 6,059,633 | A | * | 5/2000 | Currier | 450/31 |
| 6,088,831 | A | * | 7/2000 | Jensen et al. | 2/2.5 |
| 6,108,815 | A | * | 8/2000 | Majerfeld | 2/71 |
| 6,412,115 | B1 | | 7/2002 | Pontes et al. | |
| 6,567,989 | B1 | | 5/2003 | Martinez | |
| 6,698,025 | B1 | * | 3/2004 | Hughes | 2/69 |
| 6,745,400 | B1 | * | 6/2004 | Paciorkowski | 2/69 |
| 6,941,584 | B1 | * | 9/2005 | Matthews | 2/234 |
| 7,047,567 | B2 | * | 5/2006 | Allen | 2/69 |
| 7,257,846 | B2 | * | 8/2007 | Paciorkowski | 2/267 |
| 2003/0014802 | A1 | * | 1/2003 | Benham | 2/69 |
| 2003/0172431 | A1 | * | 9/2003 | Allen | 2/69 |
| 2005/0044605 | A1 | * | 3/2005 | Hofmann | 2/69 |
| 2005/0114979 | A1 | * | 6/2005 | Woolcott et al. | 2/69 |

* cited by examiner

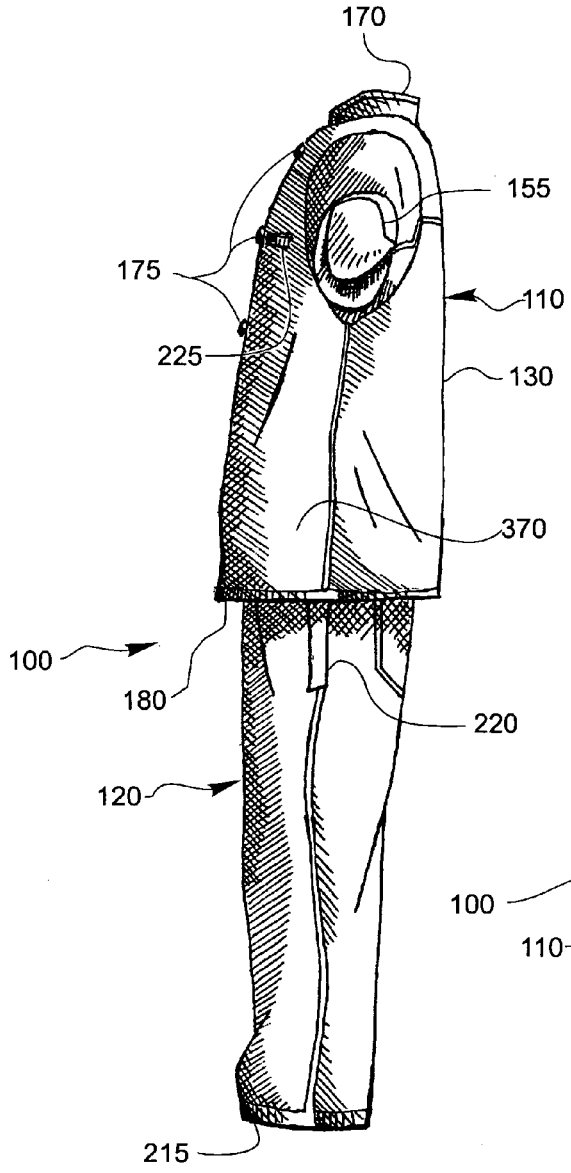
FIG. 3
FIG. 4
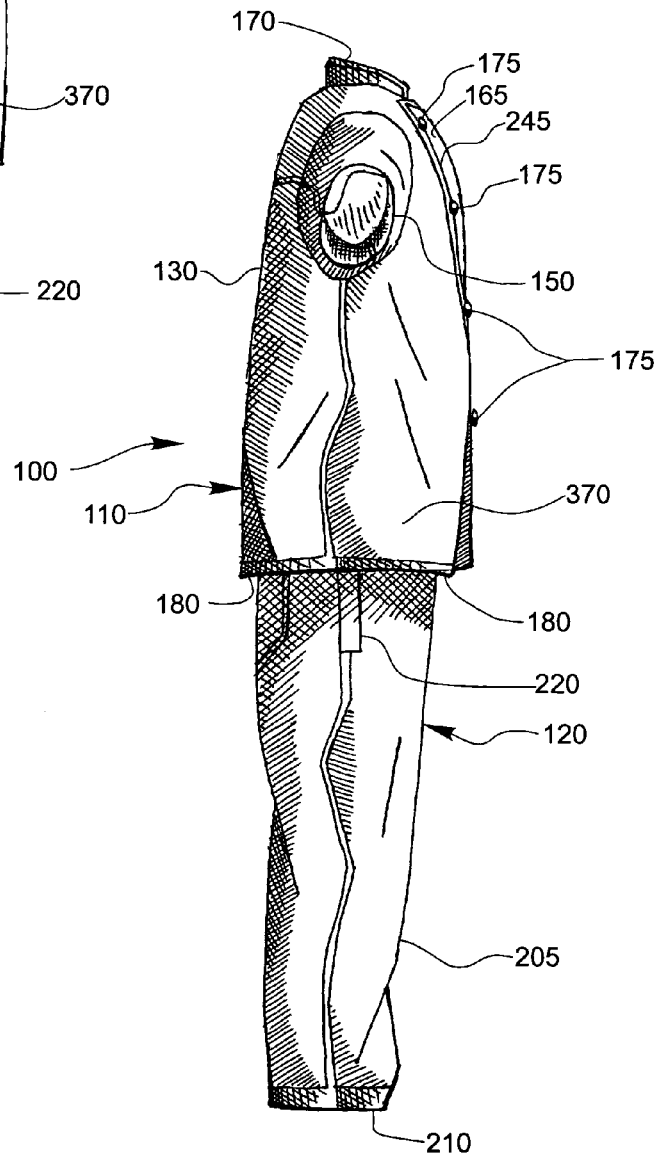

CHEF SUIT GARMENT

TECHNICAL FIELD

This invention contemplates improvements in several fields of technology and is particularly well-adapted to many specific embodiments having utility in the uniform garment industry, including for purposes of example but not for purposes of limitation, the executive chef apparel and related fields.

BACKGROUND OF THE INVENTION

For as long as there has been a desire or need for uniformity in appearance among groups of individuals, there has been a need to create uniforms and garments with a comparable, similar, or even identical appearance. With the advent of such uniforms and garments, there has also arisen the need to establish improved systems and methods for manufacturing components of the uniforms and garments. The commensurate need has also been perceived for improved uniforms and garments and components thereof that are easier to assemble, don, and that are more comfortable and functional for purposes of their intended use in service.

After use, the uniforms, garments, and components thereof must be removed, cleaned, and prepared for the next use. Those having skill in the relevant arts have over time identified various time and cost elements associated with the manufacture, use, cleaning, and servicing of the many types of such garments and uniforms that have come to find widespread utility across many industries and activities. In the uniform supply, cleaning, and delivery fields, loss prevention has gained considerable attention, especially in industries where bulk quantities of uniforms are prepared, delivered, cleaned, and returned to users.

Significant losses presently occur not only during transit mishaps, but also due to intentional separation of upper and lower uniform components during shift changes and during operation to address accidental soiling in use wherein the use will replace only an upper or a lower component.

Uniform-type garments and apparel and the components thereof that are supplied en masse to large organizations must usually be sized and fitted in advance of delivery and wear to suit the particular corporeal characteristics of the individual executive chefs and other members of the team and or organization. In one likely set of circumstances, an upper torso uniform component and a lower waist-leg uniform component are sized and matched for delivery to and to be worn by the target individuals to ensure comfortable fit and wear during use.

Those operating in the field of art have long known that many variables in the preparation and delivery process can impact whether the correct sizes of the uniform components are delivered to intended individuals. Often times, upper and lower components will be matched before delivery, but become disassociated during transit and or after delivery such that the intended individuals are inconvenienced because they do not receive the correct sizes. This results in worker discontent and discomfort, which can impact productivity.

In many organizations, such problems can at best diminish the effectiveness of a team of individuals. In one of many possible team environment examples, an executive chef team or kitchen staff of a restaurant can experience problems where spirited personal egos amplify otherwise ordinary frustration into disruptive behaviors, which can result in less than optimum timeliness and product quality.

The need to optimize the use of time and to minimize resource costs and end user problems in making and using such uniforms and garments continues to spur innovation and developments in the corresponding technology areas. Of the many aspects of such uniforms and garments that are susceptible to further improvements, those that continue to receive substantial attention include comfort, ease of donning, functionality for intended purpose, ease of removal, ease of cleaning, and ease of preparation for reuse.

In the upper scale food preparation service industries, it is common for the organization to maintain an inventory of uniforms and garments for the food preparation and delivery service staff to don during operation. Many suppliers and vendors service this field with pre-manufactured uniforms that include, for purposes of example without limitation, upper uniform components that can take various forms including double-breasted jackets, and lower uniform components that can include adjustable waist pants, aprons, shoe covers, and the like.

For a staff of 10 employees that includes an executive chef and various subordinate team members, the organization may instruct a supplier to periodically deliver a one or two week supply of uniforms for its team. In this way, each member can have a clean uniform for each day of operation, with perhaps one or two extra for exceptional circumstances where a uniform becomes soiled in use. The supplier will usually arrange the size of its inventory to accommodate the periodicity of the inventory delivery to the customer organization so that the supplier can pick up the soiled uniforms for cleaning and servicing at the same time the next period's supply of clean uniforms is delivered.

In such situations, the supplier can experience many variables that may present problems for the customer organization wherein upper and lower components can be mismatched during cleaning and reassembly for the next rotation of inventory with the customer organization. One common method employed to control such variables has been for the supplier or its manufacturer to physically join the upper and lower components, which reduce the mismatch problem. However, this approach can inject its own set of variables and problems.

While many attempts have been made to improve various aspects of the state of the art of such uniforms and garments, four attempts in recent years appear to describe the cumulative efforts. For example, one attempt that has been made to address one of the problems with such uniforms and garments in the restaurant industry is described by Bruno Berni in U.S. Pat. No. 5,343,565 in 1994 (see also his U.S. Pat. No. D355, 295 of 1995). Berni's clothing garment is limited to a jumpsuit configuration having a preattached apron, which together are primarily focused on improving the user's tolerance to cold and hot exposure as the user moves between hot kitchen and cold refrigerator food service areas.

An additional jumpsuit configuration is explained by Mr. Gregory Pontes et alia in U.S. Pat. No. 6,412,115 B1 in 2002, wherein a lightweight disposable protective coverall garment contemplates a reduction in materials subject to waste disposal. The Pontes et al. coverall also attempts to persuade that upper body sleeve portions of the garment should present an advantage if attached with a specific angular range of motion to an upper portion of the garment. Another previous endeavor of Alberto Martinez is explained in U.S. Pat. No. 6,567,989 B1 in 2003 wherein a protective garment is illustrated. However, the Martinez protective garment is restricted to a torso portion connected to a lower leg portion that is adapted to form an apron type leg protective element.

Despite the putative innovations of the previously described prior art attempts, much room for improvement remains and many problems and difficulties continue to challenge the manufacturers, suppliers, and customer end-users of uniforms and garments described above. Even though many individuals have sought to inject their improvements in the main stream of the instant uniform and garment industry, to date, all such attempts are mostly either expensive and cumbersome to implement and use with limited improvements in capability, or they simply do not address the many other persistent challenges.

The instant invention and its many possible alternative preferred embodiments address many of the short-comings of the prior art that remain: ease of use, cost to implement and maintain in service, and the reduction of the costs associated with the various problems described above. The various preferred embodiments of the invention described here address these and many other prior art difficulties with heretofore unavailable arrangements of components and new and novel configurations.

In particular, the instant invention and its various embodiments contemplate that what has been needed and unavailable is a more efficient arrangement of uniform and garment components that can easily reduce mismatch and loss. Even so, this improved benefit must still be constrained by the requirement for uniform-type garments and apparel that remain cost-effective to manufacture, and yet, which remain functionally reliable and easy-to-use in a variety of operational environments.

The instant invention addresses such needs, and accomplishes its new and novel improvements in the state of the art, without modification to the presently acceptable manufacturing, use, and maintenance cost models, and without increased difficulties in the preparation, delivery, wear, removal, and cleaning and servicing aspects of various implementations.

SUMMARY OF INVENTION

In its most general configuration, the present invention addresses the problems in the art and advances the state of the relevant technology with a variety of new features and capabilities that markedly improve prior uniform-type garments and apparel in innovative ways. In one of the many preferable configurations, the invention contemplates a unitary or multipart or multicomponent chef suit type of garment that can be configured in a variety of equally novel and useful arrangements, which all serve to improve the comfort and convenience of the wearer while optimizing the serviceability and applicability to many different operational environments.

In one of many possible preferred embodiments, the inventive chef suit can be generally adapted as a one-size fits all, uniform style chef suit that can include an upper torso component having an outer jacket and a conformally arranged inner liner. The inner liner is much like what those in the American garment industry refer to as an undershirt or a "T" shirt, which is attached to the inside of the outer jacket. The combination of the outer jacket and the inner liner also are arranged to define a lower waist free edge.

The outer jacket may also be preferably or optionally designed to incorporate a lapel arrangement that has a left breast lapel or portion adapted to overlap a right breast lapel or portion, wherein the lapels or portions are connected to a collar or neck portion much like the design of business suit garments that have become prevalent in the various segments of the garment industry.

In various configurations of the invention, the outer jacket is seamed, sewn, fastened, or otherwise joined to the inner liner about one or more seams that can preferably or optionally include a right liner seam formed along or offset or inset from a right breast lapel edge. The outer jacket can be similarly attached about another left liner seam that is formed on, offset from, or inset from a left breast lapel edge of the outer jacket. When the right and left breast lapel portions are separated, the right and left liner seams form an ingress and egress opening that enables easy donning and removal of the chef suit garment.

That is, the wearer can easily step into and out of the chef suit garment through the opening there between, all without concern for ensuring that the upper torso jacket and liner, and the lower torso pants remain matched to one another. In past situations, the jacket and the pants often become separated before and or after use.

This inadvertent and undesirable separation results in time lost in trying to match up the components, and in decreased efficiency in the servicing and cleaning of the suit garments. The user or supplier responsible for servicing and cleaning of such chef suits and garments must expend extra resources to repatriate the separated components before re-supply to the executive chef or other food service professional.

In most of the many preferred configurations, the invention also further contemplates a lower torso component that can be joined about an upper waist free edge, proximate to the top of the lower torso component, to the lower waist free edge of the upper torso component. The lower torso component is formed much like any pair of pants well-known to those skilled in the garment industry with various improvements according to the principles of the instant invention. Most typically, the lower torso component is adapted with two leg portions that are each terminated at a lower end with bottom cuff edges distal to the upper waist free edge.

The inventive chef suit garment is assembled with the upper torso component being releasably or fixedly fastened to the lower torso component wherein the upper and lower waist free edges are fastened to one another and thereby define or form a free hanging waist-less seam. This establishes a maximum of comfort for the food service professional who may experience changing waist sizes over time.

Even more importantly, the lack of a fitted waist created by the free hanging waist-less seam enables air flow inside the chef suit garment when it is worn. More specifically, when worn, the food service professional will experience air flow between the upper and lower torso components during use, which increases comfort by creating forced convection of heat and perspiration. This can be of paramount concern in food preparation environments having widely varying temperature differences between hot stove areas and cold refrigeration and cooler areas.

Even though the wearer experiences a waist free configuration with many comfort benefits, the outside observer can only perceive a food service professional wearing an executive chef suit having a jacket and pants that is in outward appearance seemingly identical to legacy executive chef garments. In modifications to any of the preferred configurations of the novel chef suit garment, as noted elsewhere herein, the upper and lower torso portions may be releasably or fixedly sewn together and or attached together with a variety of suitable fasteners that can include, for purposes of example but not for purposes of limitation, buttons, snaps, hook and loop fasteners, zippers, ties, button hooks, and the like. Most typically, such attachment and fastening methods will be incorporated proximate to the free hanging waist-less seam, which thereby establish a releasable but secure joint between the upper and lower torso components.

More preferably, the inventive chef suit garment may also be optionally configured with adjustable leg length elements wherein the two leg portions can each be formed with distal lower edges having respective bottom cuffs. On or proximate to each cuff, one or more fasteners can be included, such as hooks and loops, buttons, or snaps, which operate to enable the wearer to adjust the lower or bottom edge of each cuff by folding the edge up and over the cuff. In this way, the wearer can fit the length of the lower cuff edge for maximized comfort, optimized personal preference, and or to match the leg length of a wearer of the chef suit.

This capability can be useful to prevent the lower edge of the cuffs from dragging along the ground during use, which can prevent premature wear to the cuffs, and which can reduce soiling from contact with the floor of the working environment. In another alternative arrangement of any of the preferred embodiments, the adjustable leg length elements can be replaced with or further augmented with an elastic inner sleeve that is incorporated about the lower inside recess of the lower cuffs.

The elastic inner sleeve defines a central aperture having an elastic periphery that is adapted to grasp an ankle area of the leg of a wearer of the chef suit. This preferred or optional configuration is useful to restrain the respective distal lower edges of the cuff above a shoe of the wearer, and can be implemented alone or together with any of the other features and elements described else where herein.

Further, the embodiments of the invention are directed to configurations that also alternatively or preferably incorporate a modification to the seat or crotch area of the lower torso component that improves wearability and comfort. In this modified arrangement, the two leg portions join about an upper end to a piece of a substantially stretchable material or elastic fabric inserted there between, which joins the two leg portions about a seat and or crotch seam area.

In even more preferable arrangements, the substantially stretchable material is configured to restrain upper ends of the two leg portions together when the seat area and or crotch seam joint is free hanging and free of any stress. But when the wearer of the chef suit is moving about and stretching across the food preparation areas and stove tops, the substantially stretchable material expands and gives freely.

This improves the comfort of the wearer and maximizes the life span of the lower torso component by relieving the stress across the seat and or crotch seam. Without the substantially stretchable material, the normal wear stresses encountered can in certain situations and circumstances result in worn and torn threads and undesirable stress and wear to the material proximate to the seat and or crotch area seam joint. Minimization and elimination of such stresses and wear optimizes the serviceability of the chef suit garment and reduces the amount of the time needed for the user or supplier to clean and return the chef suit garment to operation.

In yet further variations to any of the preferred embodiments described herein, the preferred chef suit may also preferably or optionally incorporate at least one chef suit implement holder that is adapted to releasably retain at least one chef implement. Such implements can include hot/cold gloves, towels, tongs, spatulas, spoons, knives, sharpeners, and other food service implements in extensive use in the professional food service industry.

Such chef suit implement holders can take many forms in the inventive combinations according to the principles of the instant invention and can include loops, hook and loop fasteners, loops of fabric or other material that incorporate hook and loop fasteners that releasably retain such implements, buttons and holes, snap fit fasteners, and the like. Such chef suit implement holders can be incorporated about the shoulders, arms, and inner or outer lower hem of the outer jacket, as well as on various points on the lower torso component such as proximate to the waist area.

Other preferred or optional modifications are contemplated by the instant invention that can further improve the outward appearance of the chef suit garment and can include, for purposes of further illustration without limitation, at least one jacket taper adjuster incorporated about an interior midsection of the outer jacket adapted to adjust the taper of the outer jacket. These embodiments can be configured to establish an outward appearance of a tapered, fitted outer jacket, without an actual tight fitting waist that might be perceived by the wearer as an impediment.

This jacket taper adjuster can be as simple as a drawstring incorporated about in interior surface of the outer jacket, which can be cinched and tied. The taper adjuster can also include a more complex arrangement of hook and loop fasteners, buttons and tabs, and or snaps that operate to reduce the circumference of the outer jacket somewhat so as to create the appearance of a taper.

The preferred embodiments of the instant invention also further preferably contemplate a one-size fits all, uniform style executive chef suit that can include an upper torso component that is modified from other variations. In this modification, the upper torso component is formed with an inner liner that is joined about at least one torso seam to an outer jacket much like other embodiments. However, the inner liner is modified with a neck edge and a lower free form waist edge and a quick release seam that extends between the edges. The quick release seam can be a zipper, a seam formed from hook and loop fasteners, or formed from buttons and holes, wire hooks and loops, snaps, and any other equally capable and suitable means of fastening.

The instant modification can be further modified to incorporate right and left breast portions that are incorporated about respective right and left lapel portions of the outer jacket to be reversibly overlapped about one another and releasably joined when the chef suit garment is donned. This preferred or optional arrangement can extend the serviceable life between cleanings when soiling of a lapel inadvertently occurs during use. To wit, the soiled lapel breast portion can be positionally reversed or interchanged with and hidden beneath the clean lapel breast portion.

One of many possible methods for achieving this modified configuration is wherein the inner liner is joined to the outer jacket along at least one side seam that extends upwards from a point near or proximate to the lower free form waist edge. In further variations, the inner liner can be adapted to further incorporate sleeve portions that extend into respective sleeve holes that are formed in sleeves of the outer jacket.

The instant reversible lapel breast portion variation can also be incorporated with any of the other preferred embodiments described elsewhere herein. For example, a chef suit garment can be modified wherein an upper torso component is formed with a lower waist free edge and to have an inner liner joined to an outer jacket, wherein the outer jacket is adapted with overlapping front right and left breast lapel portions.

More specifically, the inner liner is generally conformally arranged within the outer jacket, but is joined to the inner liner about respective inset seams aligned with and or corresponding to the respective right and left breast lapel edges. With the inner liner seams inset on the inside of the outer jacket, the right and left breast lapel portions are thereby capable of and configured to be releasably joined and reversibly overlapped when the chef suit garment is donned.

These variations, modifications, and alterations of the various preferred and optional embodiments may be used either alone or in combination with one another and with the features and elements already known in the prior herein described, which can be better understood by those with relevant skills in the art with reference to the following detailed description of the preferred embodiments and the accompanying figures and drawings.

BRIEF DESCRIPTION OF THE DRAWINGS

Without limiting the scope of the present invention as claimed below and referring now to the drawings and figures, wherein like reference numerals, and like numerals with primes, across the several drawings, figures, and views refer to identical, corresponding, or equivalent elements, components, features, and parts:

FIGS. 3 and 4 are respectively left and right plan views, in modified scale and rotated, of the chef suit of FIGS. 1 and 2;

DETAILED DESCRIPTION OF THE INVENTION

Figure 1:
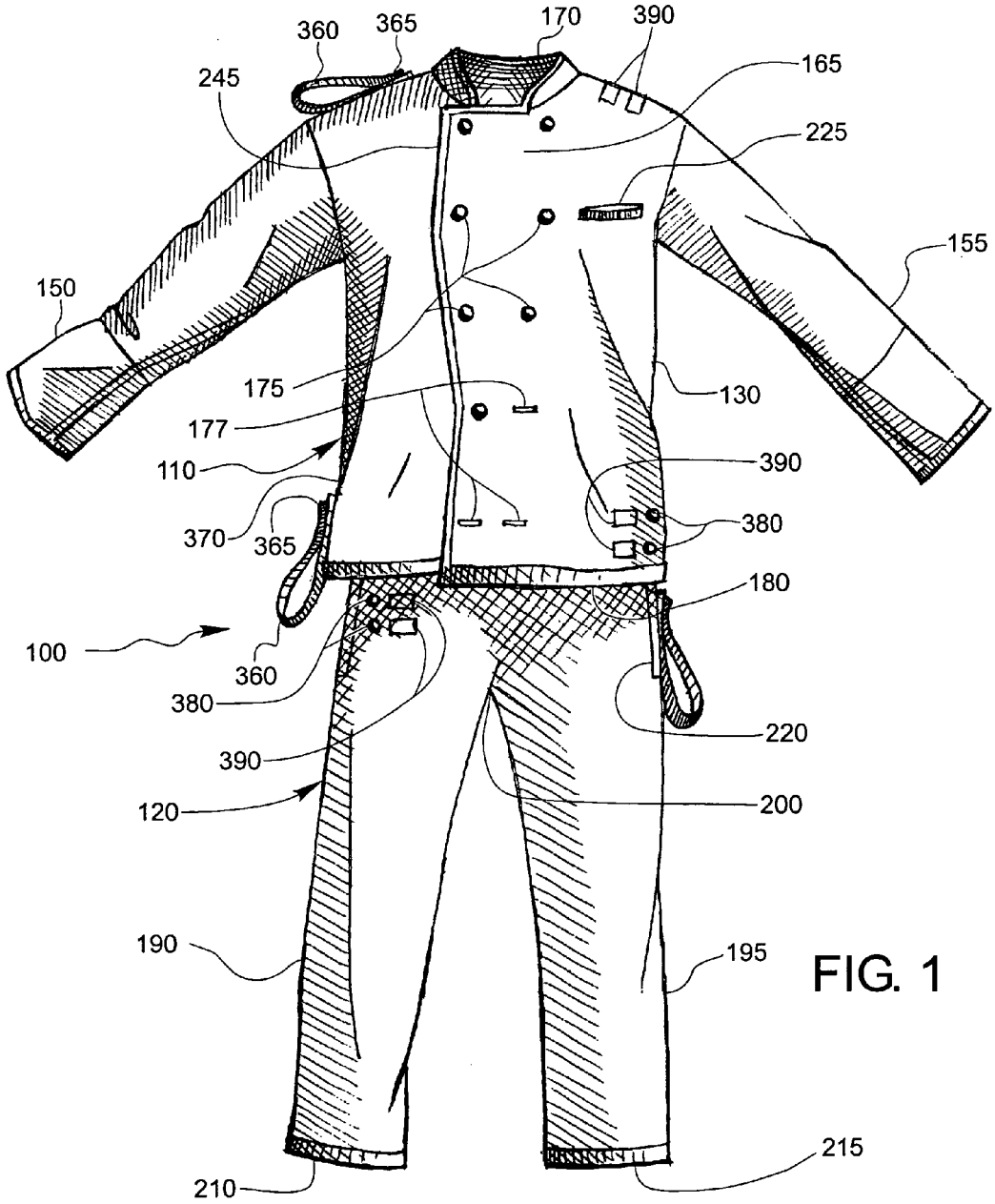
FIG. 1 is a front plan view, in modified scale, of one possible preferred embodiment of the uniform-type chef suit according to the principles of the instant invention.
Figure 2:
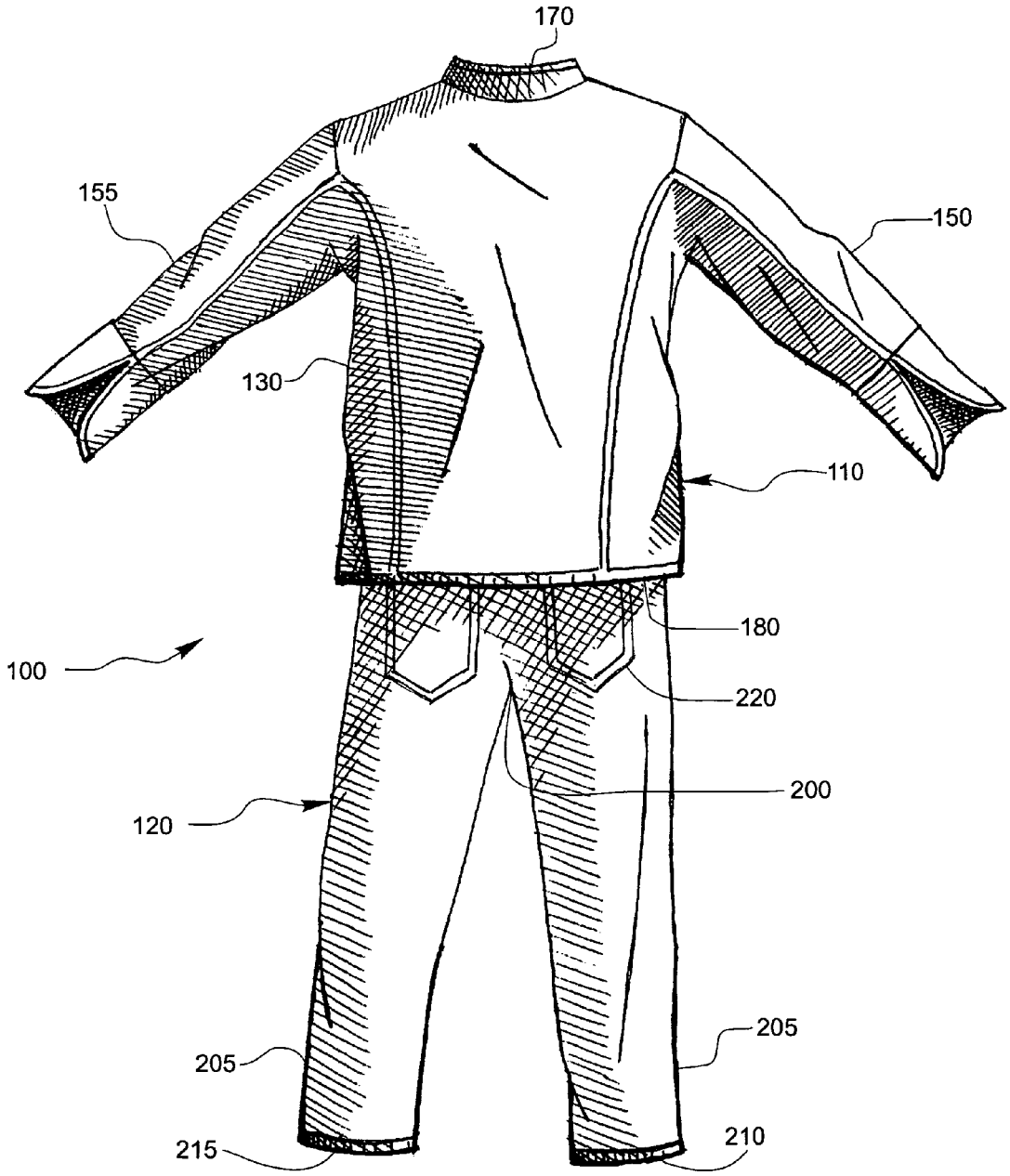
FIG. 2 is a generally rear plan view, in modified scale and rotated, of the uniform-type chef suit embodiment of FIG. 1.

In a wide range of possible embodiments and modifications and variations thereof, the heretofore unavailable chef suit garment embodiments according to the principles of the invention are denoted in general in the various drawings by reference numeral 100. Those having a modicum of skill in the art of uniform-type garments and apparel, may comprehend that a variety of possible new and novel as well as legacy component configurations are suitable for use with and contemplated by the instant invention.

If appropriately skilled in the related fields of technology and art, interested individuals may be able to readily comprehend, with reference now to the various figures including FIGS. 1 through 7, that the preferred chef suit garment 100 of the invention includes among other features and elements, an upper torso component 110 and a lower torso component 120. The upper torso component 110 preferably incorporates an outer jacket 130 and a conformally arranged inner liner 140 (FIGS. 5, 6, 7) that defines arm openings 145 registered with those of the respective sleeves 150, 155 of the outer jacket 130.

Additionally, as with many legacy garments, the instant inventive chef suit garment 100 also further contemplates, for purposes of example without limitation, the outer jacket 130 to have a right sleeve 150 and a left sleeve 155, a right breast lapel 160 and a left breast lapel 165, a jacket collar 170, and a lower free hanging hem 180. The right breast lapel 160 may be fastened against and or to the left breast lapel 165 using any of a variety of fastening devices that can include a zipper or similarly placed strips of hook and loop type fasteners, or snaps or buttons and holes (or hooks or loops that can attach to the buttons).

With continued reference to the various figures, including FIGS. 1, 3, 4, 5, 7, 9, 10, and 11, those experienced in the field may comprehend that the figures depict buttons and holes 175, 177, which can be functional and or decorative. In connection with such breast lapel 160, 165 fasteners, including the proposed decorative and or functional snaps and or buttons 175 and holes 177, the instant invention also contemplates use of breast lapel portion 160, 165 fasteners that are hook and loop type fasteners 185, 187, (FIGS. 7, 9, 10, 11) which can be of particularly desirable value in decorative button configurations wherein the hook and loop type fasteners can serve to fasten the breast lapel portions 160, 165. Such hook and loop type fasteners are often commonly referred to by those experienced in the relevant fields of art as "Velcro®" fasteners, which is a registered trademark of Velcro Industries, B.V.

The lower torso component 120 may also incorporate widely used legacy features that can include, for illustrative purposes but not for purposes of limitation, a right leg portion 190 and a left leg portion 195 that are joined at an upper end in a seat and or crotch seam 200. About a lower end 205 of the leg portions 190, 195, a respective right and left bottom cuff 210, 215 are defined. The lower torso portion may also further incorporate one or more front (not shown), side 220, or rear pockets 220. The outer jacket 130 may also incorporate one or more functional or decorative pockets about sides of the lower end 370 (FIGS. 1, 3, 4, pocket not shown), and or in a breast pocket 225 arrangement (FIGS. 1, 3).

Similarly in some respects to what is commonly referred to by those having experience in the relevant garment industry art as a "T" shirt or under shirt, the inner liner 140 may be preferably or optionally constructed of a somewhat similar cotton or other material that is suitable for comfortable wear against the skin of a wearer. The inner liner 140 may be attached to the inside of the outer jacket 130 about one or more attachment points that can include for purposes of example, one or more seams.

Figure 7:
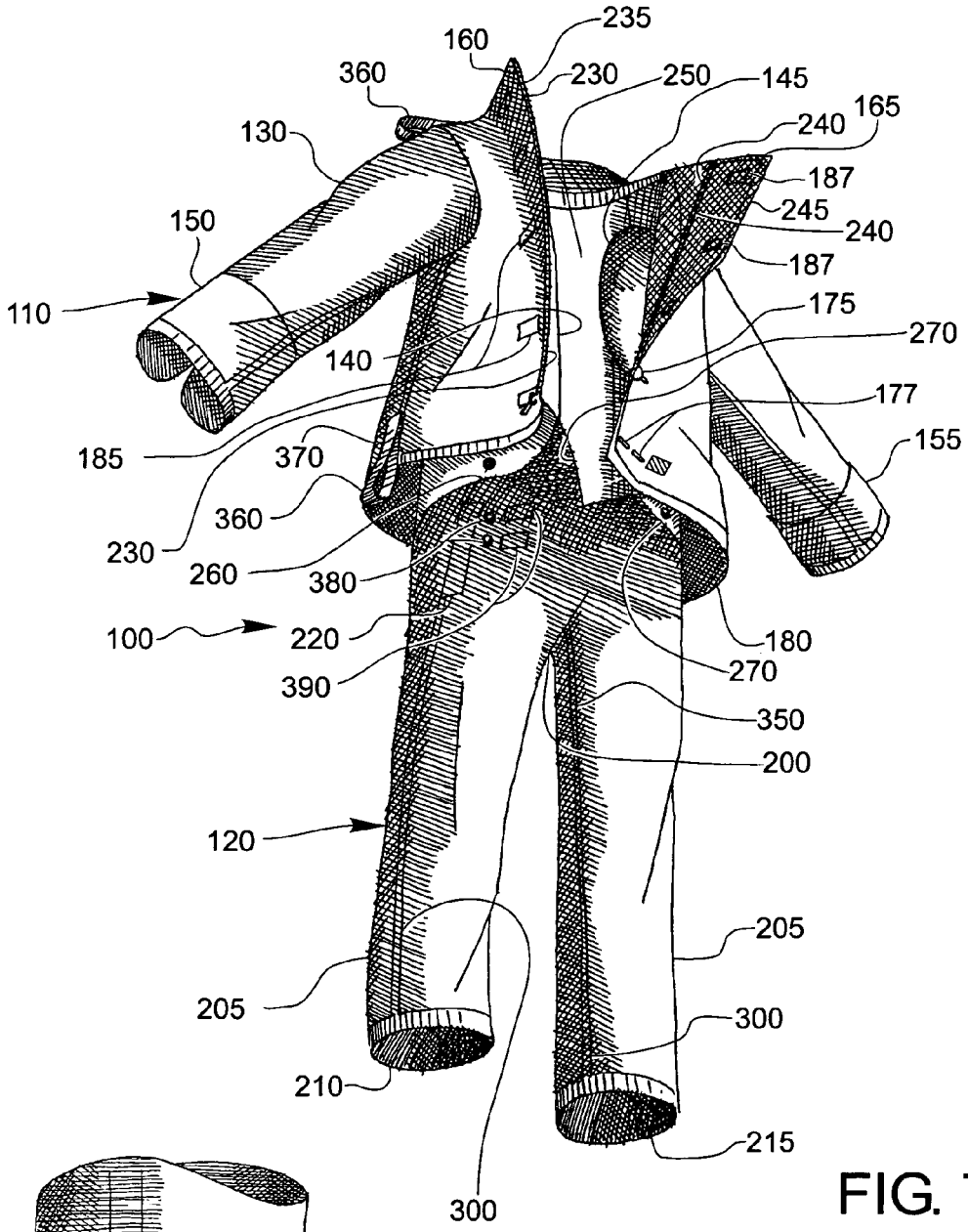
FIG. 7 is an isometric generally front view, in modified scale and rotated, of the preferred embodiment of the uniform-type chef suit of FIGS. 1 through 6.

These seams may optionally or preferably incorporate a right liner seam 230 (FIG. 7) that is formed along or offset or inset from a right breast lapel edge 235 (FIG. 7). The outer jacket 130 is preferably or optionally also attached to the inner liner 140 about an additional left liner seam 240 that is formed on, offset from, or inset from a left breast lapel edge 245 of the outer jacket 130. When the right and left breast lapel portions 160, 165 are separated, the right and left liner seams 230, 240 form an ingress and egress opening 250 (FIG. 7) that enables easy donning and removal of the chef suit garment 100.

In this configuration of one of the preferred embodiments, the outer jacket 130 may be preferably or optionally adapted to incorporate a similar breast portion lapel arrangement that has the left breast lapel or portion 165 adapted to overlap the right breast lapel or portion 160, wherein the lapels or portions 160, 165 are connected to the collar or neck portion 170 much like the design of prior art business suit garments that are worn by many business people world over.

Figure 5:
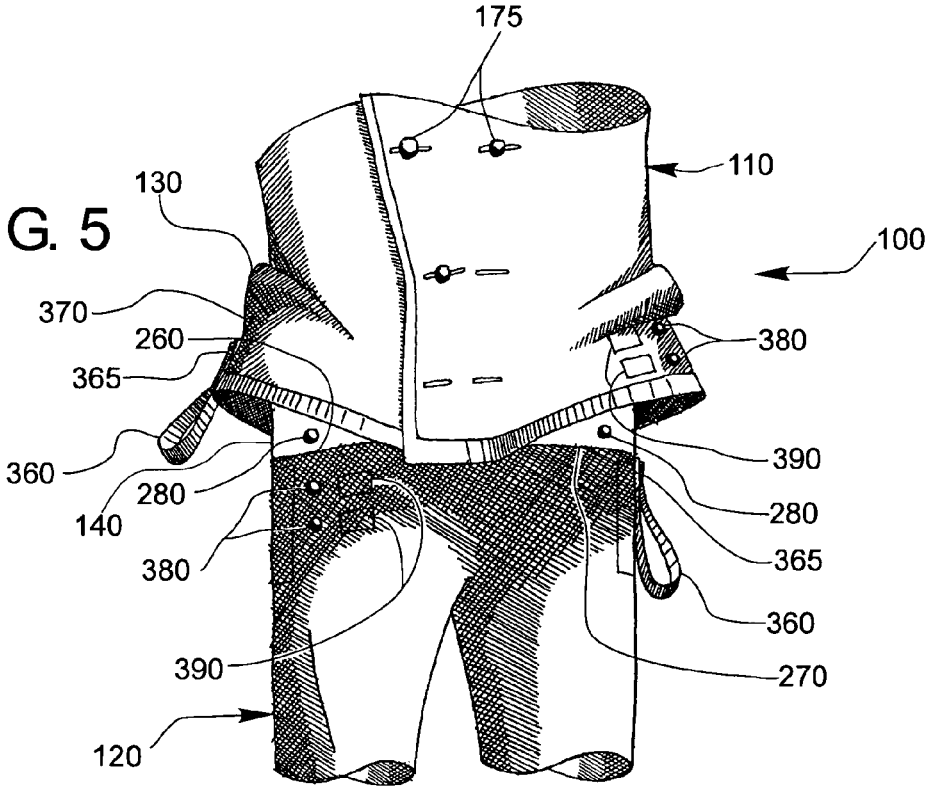
FIG. 5 is front plan view, in modified scale, and with certain structure removed or rearranged for purposes of illustrating additional features and elements of the preferred chef suit embodiments according to the instant invention.
Figure 6:
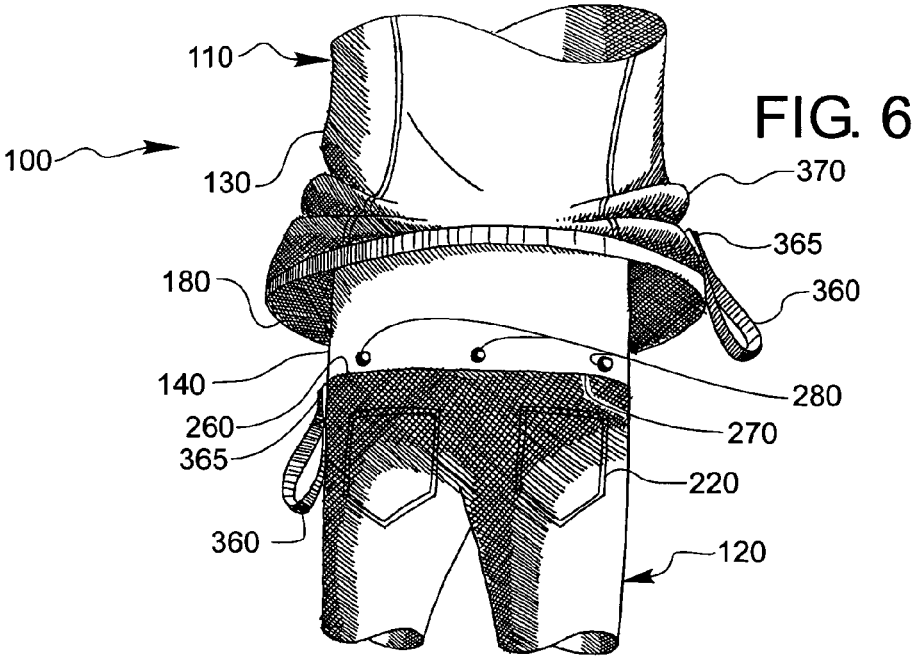
FIG. 6 is a rear plan view of the preferred embodiment of FIG. 5, in modified scale, and with various structure removed and elements rearranged for purposes of further illustration.

The combination of the outer jacket 130 and the inner liner 140 of the upper torso component 110 also are arranged to define a lower waist free edge 260 (FIGS. 5, 6, 7). The lower torso component 120 is adapted to define an upper waist free edge 270 (FIGS. 5, 6, 7) that can be releasably or fixedly fastened or joined to the lower waist free edge 260 to form or define a free hanging waist-less seam 260, 270 that supports the lower torso component 120 with the upper torso component 110, which eliminates the need for any waist to support the lower torso component 120.

As described elsewhere herein, variations of any of the embodiments of the invention can be directed to arrangements wherein the upper torso component 110 is joined to the lower torso component 120 by being sewn together, and alternatively or in combination therewith by, for purposes of example without limitation, being fastened with buttons 280 (FIGS. 5, 6). While buttons are illustrated for purposes of example, any of the other means contemplated by the invention and or known to those skilled in the art may be found to be of similar utility, including for further example, hook and loop fasteners, a continuous or discontinuously sewn seam, snaps, zippers, straps, suspenders, ties, and the like.

Figure 8:
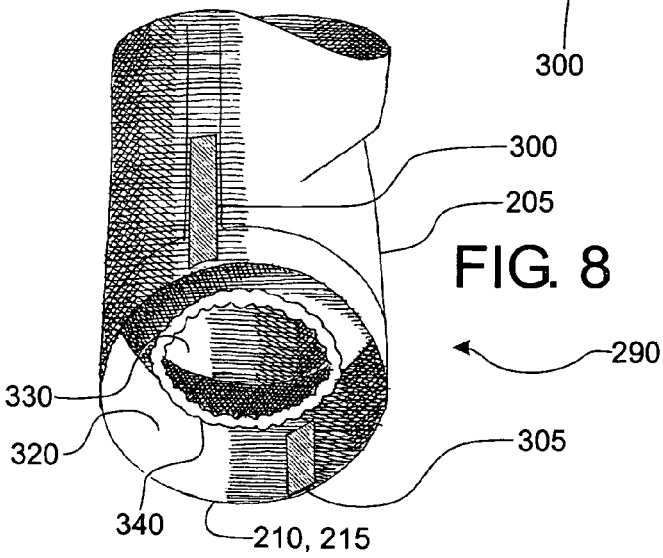
FIG. 8 is an isometric view, in enlarged scale and rotated, of a lower leg portion of the uniform-type chef suit of FIGS. 1 through 7 that describes certain additional possibly preferred elements of the invention.

With continued reference to the various figures and also now to FIG. 8, those with knowledge in the relevant arts may be able to comprehend that the instant invention also contemplates variations of the preferred embodiments that incorporate adjustable leg length elements 290 about the two leg portions 190, 195 proximate to their distal lower cuffs or edges 210, 215. On or proximate to each cuff or edge 210, 215, one or more fasteners 300, 305 can be incorporated on the interior and exterior surfaces to enable the wearer to adjust the lower or bottom edge of each cuff edge 210, 215 by folding the edge up and over or under the cuff 210, 215. Although FIG. 8 illustrates hook and loop type fasteners cooperating to create the adjustable leg length elements 290, many other possibly preferred fasteners may be determined to be of utility in this arrangement.

Further reference to FIG. 8 illustrates that other variations of such leg length adjustment capability can be of use with the incorporation or the configuration of an elastic inner sleeve 310 can be implemented, which is preferably or optionally formed about the lower inside recess 320 of the lower cuffs 210, 215. The elastic inner sleeve 310 described here includes a central aperture 330 having an elastic periphery 340, which may be incorporated in place of or in addition to use of an elastic material for construction of the sleeve 310.

Another possibly preferred or optional modification that is contemplated by the embodiments of the invention can include an additional variation to the seat or crotch area 200 wherein the seam edges 350 (FIG. 7) are reconfigured to be expandable by incorporation of an insert of a substantially stretchable material. The insert can be formed from materials such as a polymeric material or elastic fabric (not shown) that can be a neoprene or similar type of substantially stretchable material.

In any of a number of equally possible and desirable arrangements of this particular variation, the two leg portions 190, 195 are attached near the upper end proximate to the seat or crotch area 200 to the piece of a substantially stretchable material or elastic fabric. The substantially stretchable material or elastic fabric is inserted there between to replace the seam that otherwise joins the two leg portions 190, 195 about the seat and or crotch seam area 200.

Those individuals with some knowledge of the food preparation arts may be able to appreciate that executive chefs and other food service preparation professional have a persistent need to utilize various implements in their daily tasks. With continued reference to the various figures, including FIGS. 1, 5, 6, 7, and 11, such individuals should be able to further comprehend that the instant invention may be further preferably or optionally adapted with at least one chef suit implement holder adapted to releasably retain such an implement.

As stated elsewhere herein, such implements can include, for purposes of illustration alone, but not for purposes of limitation, hot/cold gloves, towels, tongs, spatulas, spoons, knives, sharpeners, and other food service implements that have become widely accepted and used in the various professional food service industries.

One such adaptation of a possible implement holder can be a loop of any type of desired material, such as a fabric loop 360 that incorporates an optional quick release snap, hook and loop fastener, button, or other fastener 365 (FIGS. 1 & 7), and which can be mounted to a should portion, fore arm or upper arm portion, or other location on a surface of the outer jacket 130.

Figure 11:
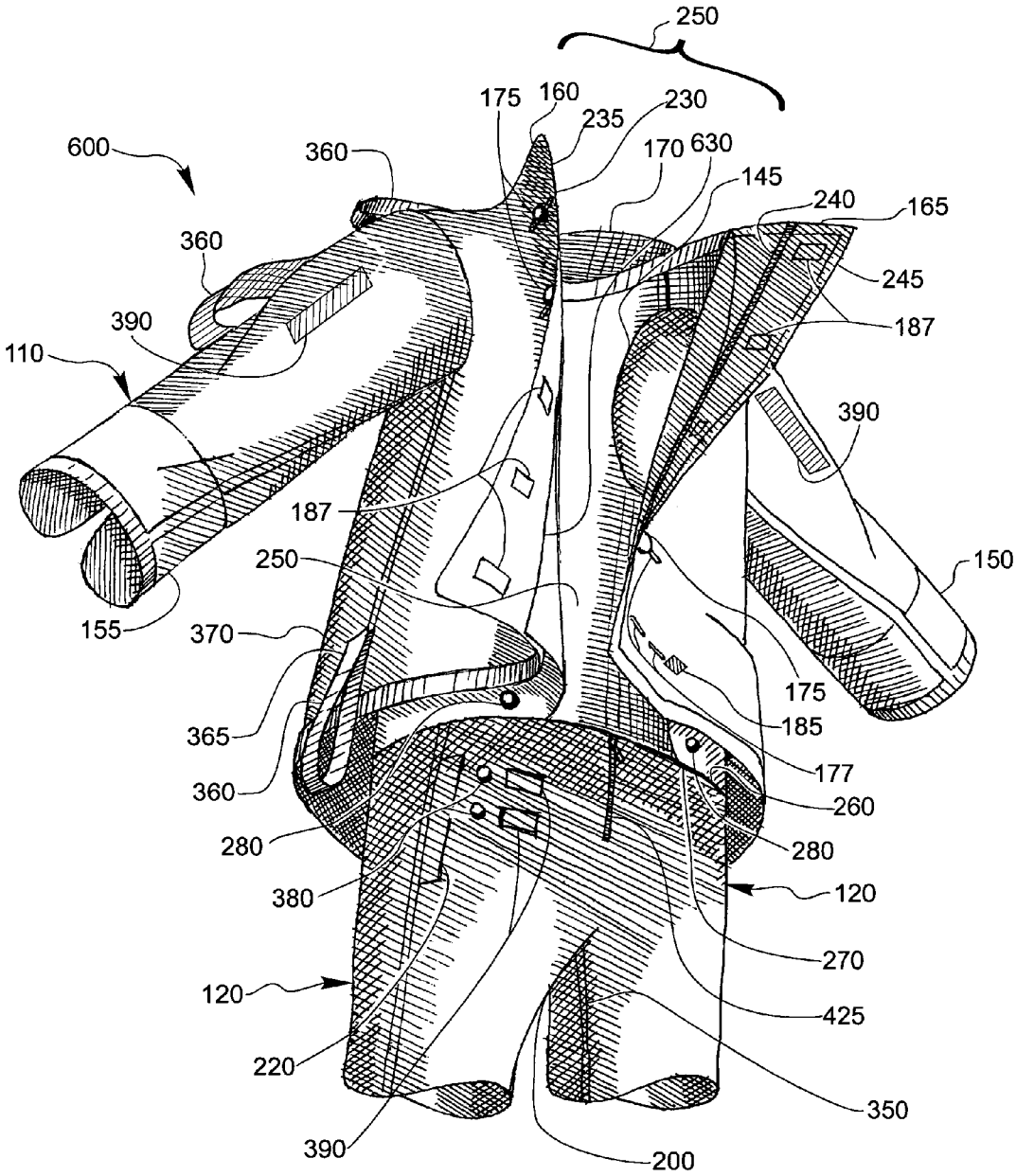
FIG. 11 is a generally front plan view, in modified scale and rotated, of another preferred but optionally modified configuration of the chef suit according to the principles of the instant invention.

This type of implement holder loop 360 is useful for a variety of possible utilities including, for purposes of example without limitation, temporarily holding a towel, wipe, or executive chef hat or other head wear (not shown) in a convenient, easy to reach location that is out of the way of open flames, soiled surfaces, and food stuff in the process of preparation. Such loop type implement holders 360 may also be preferably or optionally included about other locations of the inventive chef suit garment 100, including for purposes of further illustration, proximate to a lower location 370 of the outer jacket 130 (FIGS. 1, 5, 6, 7), and or about an upper arm location of the outer jacket 130 (FIG. 11).

In addition to a loop type implement holder 360, the other types of chef suit implement holders contemplated by the principles of the instant invention are preferably or optionally also directed to embodiments that include hook and loop fasteners, buttons and holes, snap fit fasteners, and similar components. Continued reference to the various illustrations, including FIGS. 1, 5, 6, 7, and 11, may inspire those having some knowledge in the food service preparation and garment industry areas to understand that such additional chef suit implement holders may preferably or optionally include hook and loop and or snap fastener pads.

One variation of such additionally contemplated implement holders are those illustrated in the figures as button-type and or snap-type implement holder fasteners 380 and hook-and-loop-type fasteners 390 (FIGS. 1, 5, 7, 9, 10, 11), which can be of service in connection with corresponding fastener components that are either found on existing implements and or that can be easily added to such implements (implements not shown).

Figure 9:
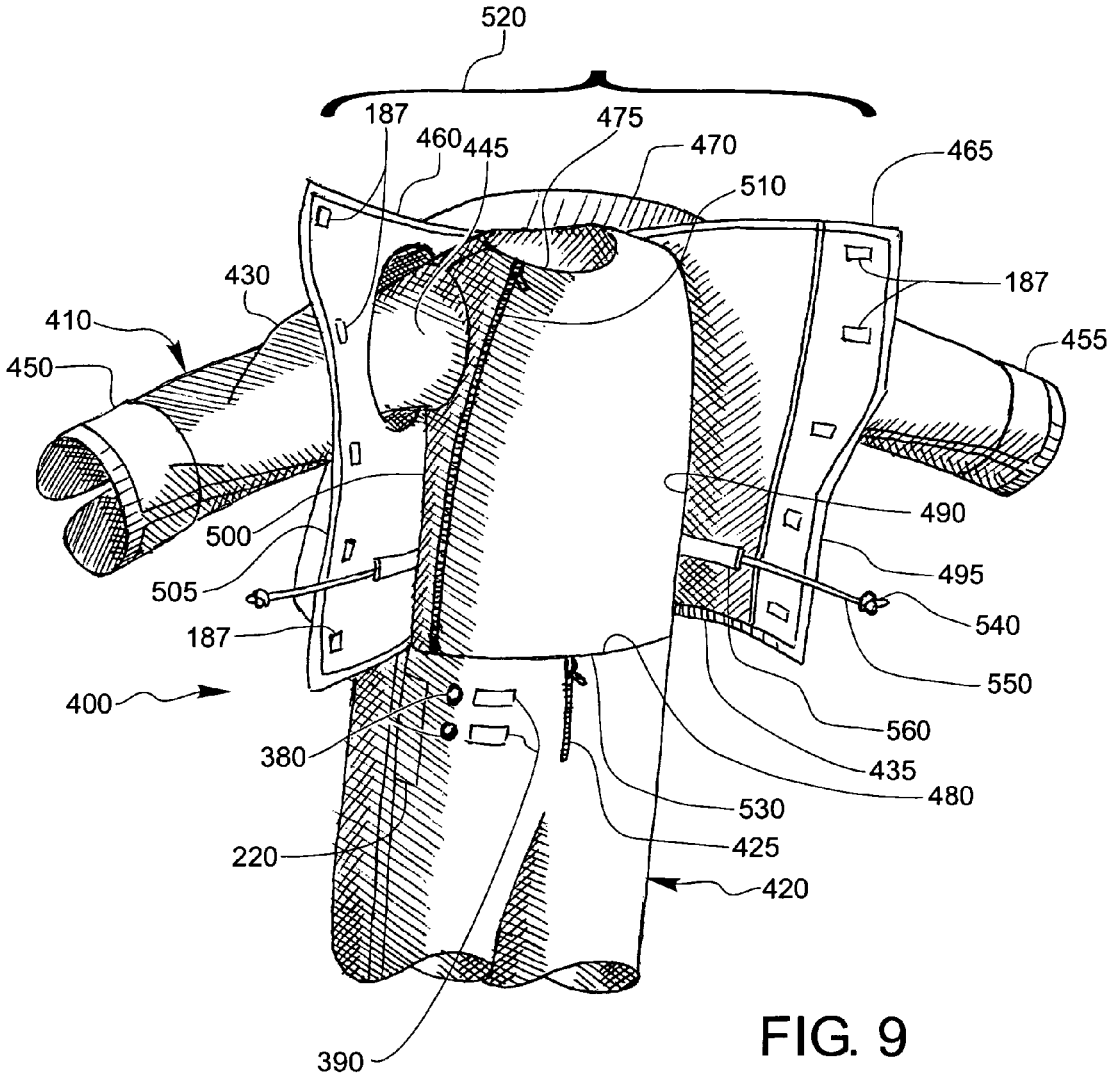
FIG. 9 is a generally front plan view, in modified scale and rotated, with certain structure removed for purposes of further description and example, of a modified preferred configuration of the chef suit of the preceding figures.
Figure 10:
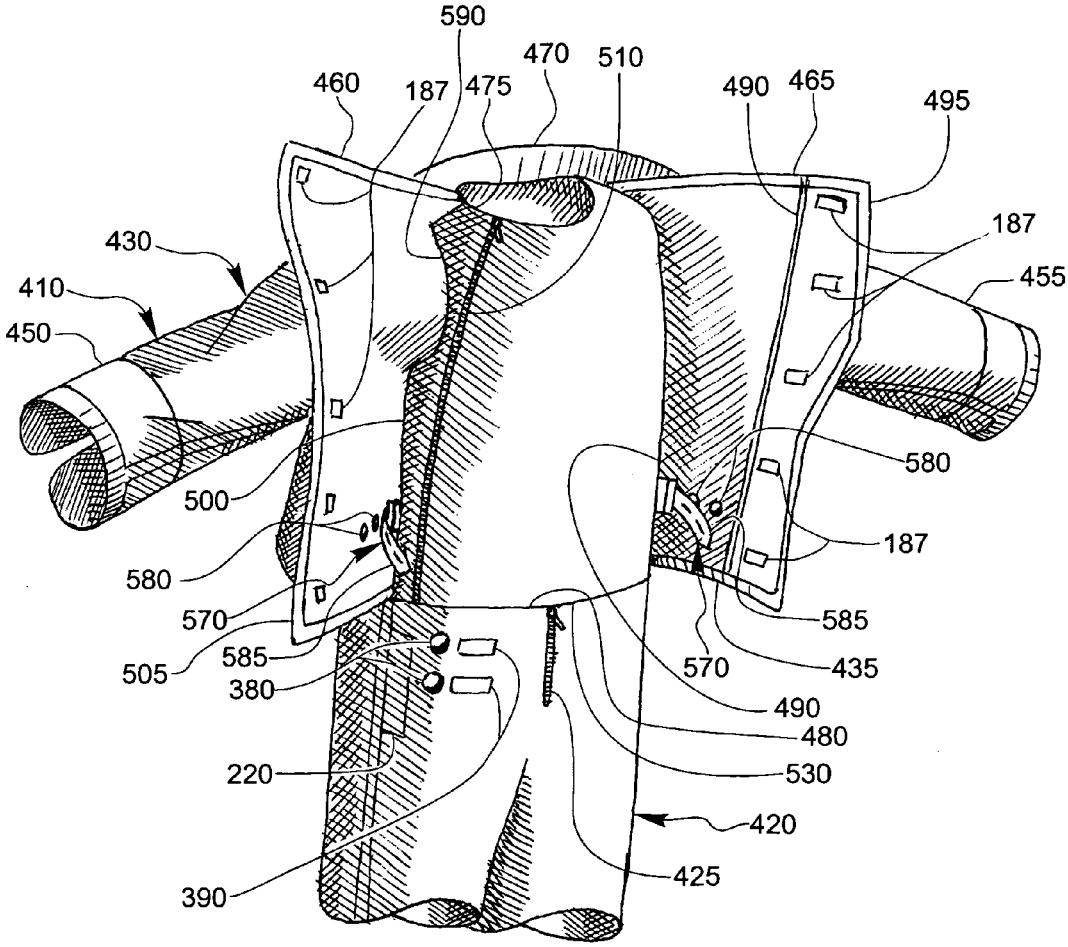
FIG. 10 is a generally front plan view, in modified scale and rotated, with certain structure removed for illustration purposes, of an additional alternative preferred configuration of the chef suit of the preceding figures.

With continued reference to the previously described figures and illustrations and also now to FIGS. 9 and 10, those skilled in the pertinent fields of endeavor may also come to know that the instant invention further contemplates another variation to the already detailed one-size fits all, uniform style executive chef suit 400. This modified variant of any of the preceding embodiments may also preferably or optionally incorporate an upper torso component 410 and a lower torso component 420, which may incorporate a zipper 425. The upper torso component 410 preferably incorporates an outer jacket 430 with lower edge 435 and a conformally arranged inner liner 440 defined with liner sleeves 445 that are registered with those of the respective right and left sleeves 450, 455 of the outer jacket 430.

Similar to other embodiments and variations thereof, this chef suit garment 400 is directed to the outer jacket 430 being adapted with a right breast lapel 460 and a left breast lapel 465, a jacket collar 470, neck edge or line 475, and a lower free form waist edge 480. The lapels 460, 465 may be fastened as already described.

For generally conformal attachment to the inside of the outer jacket 430, the inner liner 440 may optionally or preferably incorporate a right liner seam 490 formed along or offset or inset from a right breast lapel edge 495. One of desired or alternative configurations suitable for use in this modified configuration may have the inner liner 440 fastened to the outer jacket 430 along at least one side seam 500 that extends upwards from a point on, near, or proximate to the lower free form waist edge 480. Also, the additional left liner side seam 500 is formed on, offset from, or inset from a left breast lapel edge 505 of the outer jacket 430.

The inner liner 440 is also formed with a releasable, ingress-egress, quick-release seam and or closure 510 extending from the neck edge 475 to the lower free form waist edge 480. The closure 510 can be preferably or optionally configured as a zipper, strips of hook and loop fasteners, buttons, snaps, and similar releasable closure devices. When the releasable closure 510 is opened, and when the right and left breast lapel portions 460, 465 are separated, the right and left liner seams 490, 500 form an ingress and egress opening 520 for easy removal and donning of the chef suit 400.

As with other embodiments disclosed elsewhere herein, with the right and left liner seams 490, 500 being inset as shown in FIGS. 9 & 10 from the edges 495, 505, the right and left breast lapel portions 460, 465 are reversibly overlapping. Also similar to other configurations and variations elsewhere disclosed, the modified chef suit 400 of the instant invention also includes the lower torso component 420 to have an upper waist free edge 530.

The edge 530 is releasably or fixedly fastened or joined to the lower waist free edge 480 to form and or define a free hanging waist-less seam 480, 530. The waist-less seam 480, 530 thereby formed supports the lower torso component 420 with the upper torso component 410. As with other variations, buttons (not shown) as well as many other types of fastening arrangements may be equally desirable depending upon serviceability, operational, and working environment considerations and circumstances.

With renewed reference to the previous written description of the invention and the various figures, especially with continued reference to FIGS. 9 & 10, another innovative feature of the instant invention is revealed in connection the modified chef suit garment 400. Here, a preferred or alternative configuration is present that incorporates at least one jacket taper adjuster 540 that functions to adjust the taper of the outer jacket 430 as explained elsewhere herein.

As shown in FIG. 9, the at least one jacket taper adjuster 540 may be adapted as a drawstring 550 movably received about the interior surface of the outer jacket 430. The drawstring 550 variant may further include a reinforcement strip and or sleeve and or attach strip 560 for improved operation when the drawstring 540 is cinched and tied or fastened.

An alternative taper adjuster 570 shown in FIG. 10 may also preferably or optionally incorporate a more different arrangement of hook and loop fasteners, buttons and tabs 580, 585, and or snaps that operate as noted to adjust the taper of the jacket. FIG. 10 also illustrates another variation on any of the embodiments and modifications described here, and reflects inner liner 440 being modified to exclude the sleeves 545 of FIG. 9 in place of an extended left inner seam 500 that is formed around the inner sleeve of the outer jacket 430.

With further reference now also to FIG. 11, those knowledgeable in the garment industry and related fields of technology may be able to understand that the principles of the instant invention are directed to yet another preferred or optional modification to any of the embodiments described herein. More specifically, an alternative chef suit garment 600 is contemplated to have most of the elements described in connection with the embodiments illustrated in FIGS. 1 through 7. However, in the alternative arrangement described in FIG. 11, an inset right liner seam 630 is contemplated that enables improved reversibility of right and left breast lapel portions 160, 165.

Numerous alterations, modifications, and variations of the preferred embodiments disclosed herein would be apparent to those skilled in the art and they are all contemplated to be within the spirit and scope of the instant invention, which is limited only by the following claims. For example, although specific embodiments have been described in detail, those with skill in the art can understand that the preceding embodiments and variations can be modified to incorporate various types of substitute and/or additional materials, components, relative arrangements of components, features, elements, and dimensional configurations for compatibility with the wide variety of possible applications that are susceptible for use with the inventive uniform-type chef suit garment according to the principles of the instant invention. Accordingly, even though only few such embodiments, alternatives, variations, and modifications of the present invention are described herein, it is to be understood that the practice of such additional modifications and variations and the equivalents thereof, are within the spirit and scope of the invention as defined in the following claims.

I claim:

1. A chef suit garment, comprising:

an upper torso component formed with a lower waistband free edge and having an inner liner joined to an outer jacket, the outer jacket being adapted with overlapping front right and left breast portions, the inner liner defining the lower waistband free edge;

the inner liner generally conformally arranged within the outer jacket and joined to the outer jacket about respective inset seams corresponding to the respective right and left breast edges;

a lower torso component permanently joined about a proximate upper waistband free edge to the lower waistband free edge of the upper torso component, and formed with two leg portions;

wherein the lower waistband free edge and the upper waistband free edge together define a free hanging seam that extends from a front portion of the garment to a back portion of the garment such that the lower torso component is supported solely by the upper torso component when the chef suit garment is worn by a user and air flow is enabled within the chef suit garment between the upper and lower torso components;

wherein the right and left breast portions are configured to be releasably joined and reversibly overlapped when the chef suit garment is donned; and wherein the outer jacket includes a lower free hanging hem at a bottom edge of the outer jacket that extends continuously from the front left breast portion to the front right breast portion and around a user's back, the lower free hanging hem of the outer jacket being configured to conceal the free hanging seam.

2. The chef suit according to claim 1, wherein the two leg portions incorporate about a distal lower edge, respective bottom cuffs each formed with at least one fastener that enables adjustment of a respective distal lower edge of each cuff by folding up to fit the leg length of a wearer of the chef suit.

3. The chef suit according to claim 1, wherein the two leg portions each respectively incorporate about distal lower edges an elastic inner sleeve adapted to grasp an ankle area of the leg of a wearer of the chef suit to restrain the respective distal lower edges above a shoe of the wearer.

4. The chef suit according to claim 1, wherein the two leg portions incorporate a substantially stretchable material that joins the two leg portions about a seat seam area.

5. The chef suit according to claim 1, further comprising:

at least one chef suit implement holder, adapted to releasably retain at least one chef implement, and incorporated on at least one of (1) an exterior surface of the jacket of the upper torso component and (2) the lower torso component proximate to the upper waistband free edge.

6. The chef suit according to claim 1, further comprising:

at least one jacket taper adjuster incorporated about an interior mid section of the outer jacket adapted to adjust the taper of the outer jacket.

7. A chef suit, comprising;

an upper torso component formed with an inner liner joined about at least one side seam to an outer jacket, the inner liner having a neck edge and a lower free hanging waist edge and a quick release seam extending between the edges, the at least one side seam extending upwards from a point proximate to the lower free hanging waist edge; and a pants component permanently joined about an upper waistband free edge to the lower free hanging waist edge of the upper torso component such that the pants component is supported solely by the upper torso component when the chef suit is worn by a user, the pants component being formed with two leg portions each formed distally with lower cuff edges, wherein the lower free hanging waist edge and the upper waistband free edge together define a free hanging seam that extends from a front portion of the garment to a back portion of the garment;

wherein the outer jacket includes a lower free hanging hem at a bottom edge of the outer jacket that extends continuously from the front left breast portion to the front right breast portion and around a user's back, the lower free hanging hem is configured to conceal the free hanging seam; and wherein the quick release seam has an opened position and a closed position, the open position of the quick release seam defining an ingress and egress opening for removal and donning of the chef suit.

8. The chef suit according to claim 7, further comprising:

right and left breast portions incorporated about respective right and left portions of the outer jacket to be reversibly overlapped about one another and releasably joined when the chef suit garment is donned.

9. The chef suit according to claim 7, wherein the two leg portions each respectively incorporate about distal lower edges an elastic inner sleeve adapted to grasp an ankle area of the leg of a wearer of the chef suit to restrain the respective distal lower edges above a shoe of the wearer.

10. The chef suit according to claim 7, wherein the inner liner further incorporates sleeve portions extending into respective sleeve holes formed in the outer jacket.

11. The chef suit according to claim 7, further comprising:

at least one chef suit implement holder, adapted to releasably retain at least one chef implement, and incorporated on at least one of (1) an exterior surface of the jacket of the upper torso component and (2) the lower torso component proximate to the upper waistband free edge.

12. The chef suit according to claim 7, further comprising:

at least one jacket taper adjuster incorporated about an interior mid section of the outer jacket adapted to adjust the taper of the outer jacket; and wherein the two leg portions incorporate a substantially stretchable material that joins the two leg portions about a seat seam area.

13. The chef suit according to claim 1, wherein the lower free hanging hem is positioned intermediate a distal lower edge of the leg portions and the free hanging seam.

14. The chef suit according to claim 7, wherein the lower free hanging hem is positioned intermediate the lower cuff edges and the free hanging seam.

* * * * *